United States Patent [19]

St. Cyr

[11] 4,006,702

[45] Feb. 8, 1977

[54] ROAD BUOY

[76] Inventor: Napoleon St. Cyr, 10 Overland Drive, Stratford, Conn. 06497

[22] Filed: Aug. 28, 1975

[21] Appl. No.: 608,579

[52] U.S. Cl. ..... 116/63 P; 240/6.4 R

[51] Int. Cl.[2] ..... E01F 9/10

[58] Field of Search ..... 116/63 P, 63 R; 350/97; 404/9, 10; 240/6.4 R

[56] References Cited

UNITED STATES PATENTS

| | | | |
|---|---|---|---|
| 2,806,131 | 9/1957 | Palmer | 116/63 P |
| 2,819,547 | 1/1958 | Clements | 116/63 R |
| 3,197,628 | 7/1965 | Schuff | 116/63 P |
| 3,250,241 | 5/1966 | Levy | 116/63 P |
| 3,442,247 | 5/1969 | Osterberg | 116/63 P |
| R26,779 | 2/1970 | Weichenrieder | 116/63 R |

FOREIGN PATENTS OR APPLICATIONS

| | | | |
|---|---|---|---|
| 603,348 | 3/1960 | Italy | 116/63 P |

*Primary Examiner*—S. Clement Swisher
*Assistant Examiner*—Denis E. Corr
*Attorney, Agent, or Firm*—Wooster, Davis & Cifelli

[57] ABSTRACT

A road buoy generally comprises a weighted base and a collapsible marker portion. When the road buoy is in use, the collapsible portion, which is brightly painted for high visibility, is expanded to its full operational height. When the road buoy is being stored or transported, the collapsible marker portion is folded down to facilitate handling and to reduce the amount of storage space required. The collapsible marker portion, which can hold a warning flasher light, is removably attached to the weighted base permitting either portion of the road buoy to be easily repaired or quickly replaced if damaged.

4 Claims, 12 Drawing Figures

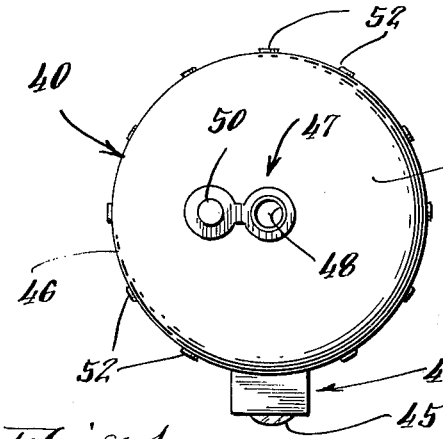
Fig. 3.
Fig. 1.
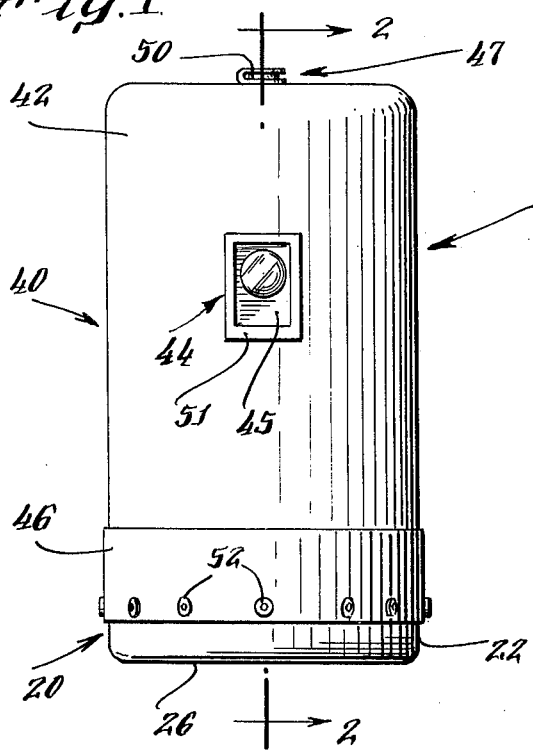
Fig. 2.
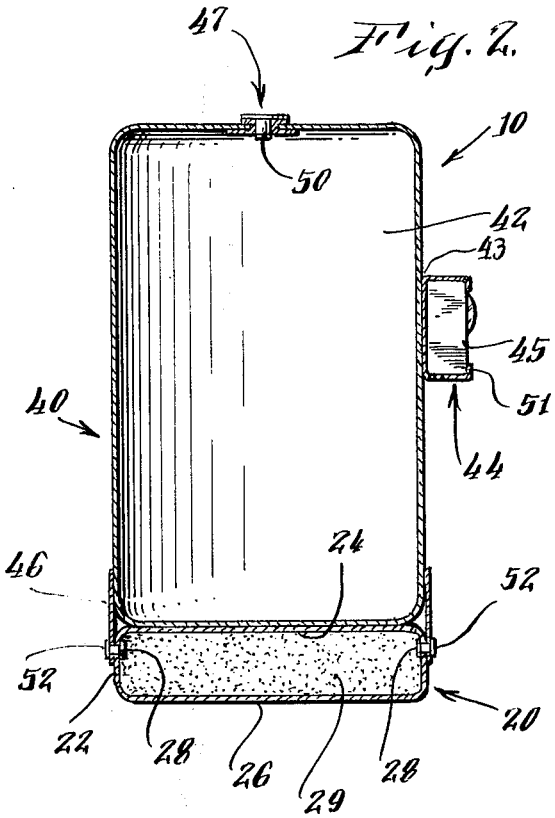
Fig. 4.
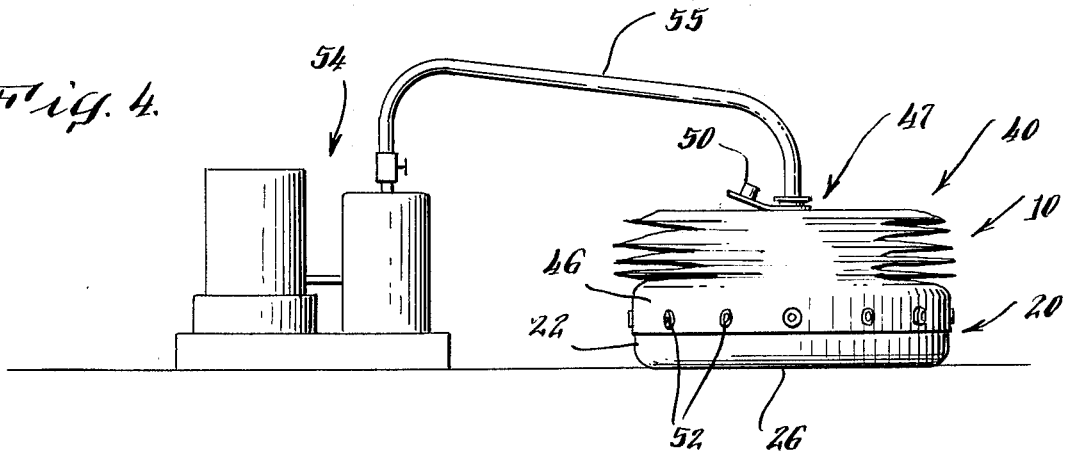

ROAD BUOY

BACKGROUND OF THE INVENTION

This invention relates to a road buoy which is used as a warning or traffic control marker primarily in those areas where road construction or repair is taking place. The road buoys serve to guide the traffic around the construction site, and also provide a barrier between the traffic and the construction crews.

Empty steel barrels or oil drums, sometimes striped alternately with orange and white paint, are the most common of such prior road markers. Although they are widely used, these prior road buoys have several serious drawbacks. In order to be sufficiently visible to the motorist, these steel barrels must be of considerable size. In addition, a great number must be used around large-scale road construction or repair sites. Consequently, because of the size of each barrel and the number needed, they require a very great amount of storage space when not in use. Furthermore, for the same reasons, transportation of the barrels is also a major problem. Cargo space on trucks is necessarily limited, and therefore, because of the amount of space occupied by only a few of these barrels, transportation to the job location of any number at all requires many trucks or many trips by a few vehicles. In either case, the transportation cost is considerable. As these barrels are traditionally made of a relatively heavy gauge steel, they are quite heavy, which further complicates transportation and handling.

More importantly, however, the substantial weight of these markers creates a serious safety hazard. These markers are often struck by passing vehicles and can cause severe damage to the cars themselves. Furthermore, they also present a danger to the construction crew since these heavy barrels may be knocked into the crew when hit. Also, these heavy road markers can create a major traffic hazard since they can roll when tipped and could roll into a lane of fast moving traffic.

Finally, these prior markers have not been specifically designed for use as road markers. Accordingly, they have no provision for holding a flashing warning light for use in the dark unless such means are added at considerable expense. Therefore, these prior markers are generally difficult to see at night on a section of road which is not independently lighted, thereby presenting yet another safety hazard. Further, once these prior markers have been damaged so that they cannot stand upright, they cannot be repaired but must be entirely replaced.

Although they present storage, transportation and safety problems, these barrel markers are popular and widely used today.

SUMMARY OF THE INVENTION

A road buoy according to the invention herein is easier to store, transport, handle and repair, and at the same time safer to use than prior road markers. The road buoy comprises a weighted base and a large collapsible marker portion which is detachably mounted on top of the weighted base and may be brightly painted for high visibility.

In one embodiment, the collapsible marker portion of the road buoy is an inflatable cylinder. This air-tight cylinder is made of a flexible material, such as polyethylene, and is provided with a large diameter opening in its top so that it is capable of being quickly inflated or deflated. In addition, the inflatable cylinder has a compartment for receiving and supporting a flasher warning light.

In another embodiment of this invention, the collapsible marker portion of the road buoy comprises a single strip of plastic or other suitable material. The strip is spirally coiled and the outermost coil is removably fastened to the inside of a cup-shaped weighted base. The successive coils can be telescopically expanded to an operational height or collapsed so as to fit entirely inside the weighted base for storage and transportation. Instead of the single strip of material, an interengaging series of open-ended truncated cones of progressively decreasing diameter can be used. These cones are concentrically arranged, and the outermost cone is removably fastened to the inside of the cup-shaped weight base. The truncated cones can be telescopically expanded to an operational height.

In another embodiment, the collapsible portion is comprised of a coil spring covered with a brightly painted flexible material, such as vinyl or fabric. The coils are of decreasing diameter and fit inside one another when the spring is compressed. The largest coil is removably fastened to the inside of the cup-shaped weighted base. When compressed, all the coils fit inside the base for storage. They are held in place by a cover which interlocks with the base.

Due to their small size when they are collapsed, these road buoys do not require much storage or transportation space. Furthermore, their overall light weight facilitates handling and eliminates the safety problems inherent in the prior art road markers. In addition, if either portion of the road buoy is damaged, it can be easily repaired or, depending upon the extent of the damage, entirely replaced.

OBJECTS OF THE INVENTION

Accordingly, a principal object of the present invention is to provide a road buoy which is easier to store and transport than known road markers.

Another object of the present invention is to provide a road buoy which is safer than known road markers.

Another object of the present invention is to provide a road buoy which can be easily repaired.

Other and more specific objects of the invention will be in part obvious and will in part appear from the following description of the preferred embodiments and claims taken together with the drawings.

BRIEF DESCRIPTION OF THE DRAWINGS

FIG. 1 is a front view of a road buoy according to the invention herein in its inflated condition;

FIG. 2 is a sectional view of the road buoy of FIG. 1 taken along lines 2—2 of FIG. 1;

FIG. 3 is a top view of the road buoy of FIG. 1;

FIG. 4 is a front view of the road buoy of FIG. 1 in its collapsed condition and showing an air pump connected thereto;

The same reference numbers refer to the same elements throughout the various Figures.

DESCRIPTION OF THE PREFERRED EMBODIMENTS

Figure 8:
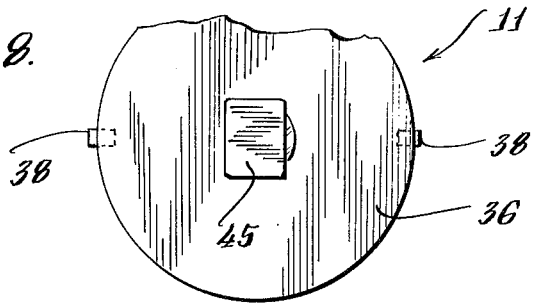
FIG. 8 is a top view of the road buoy of FIG. 5.
Figure 5:
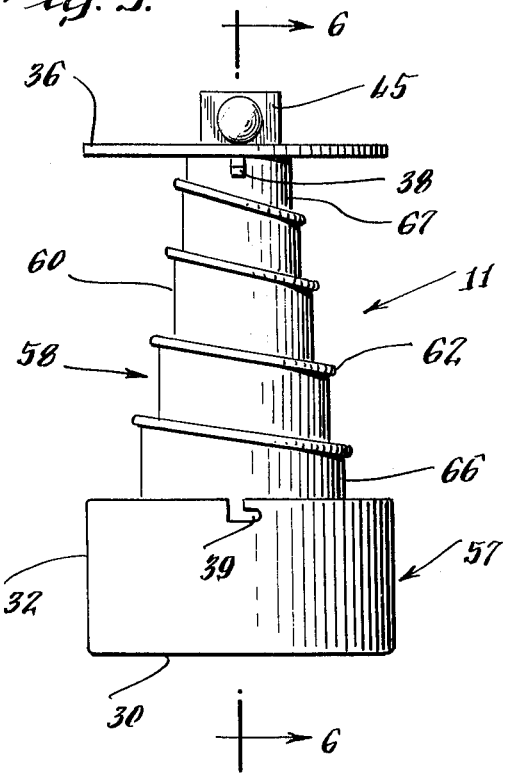
FIG. 5 is a front view of another road buoy according to the invention herein in its extended condition.

Referring now to FIGS. 1 – 4, a first embodiment 10 of a road buoy according to the invention herein is shown. The road buoy 10 generally comprises two main elements which are a weighted base 20 and a collapsible marker portion 40.

As shown in FIG. 2, the weighted base 20 has a cylindrical side wall 22, a top 24 and a bottom 26, both of which are flat and disposed perpendicularly to the longitudinal axis of the cylindrical side wall 22. The base 20 also has a plurality of male snap fasteners 28 equally spaced around the outside of the cylindrical side wall 22, as best seen in FIGS. 2 and 3. The weighted base 20 is hollow and contains sand 29 or other suitable ballast material to provide the mass necessary to anchor the road buoy in place and to maintain it in an upright position. The weighted base 20 is preferably fabricated of a rugged plastic which has the advantages of being weatherproof and difficult to break.

The collapsible marker portion 40 of the road buoy 10 is generally comprised of an inflatable cylindrical bag 42 including an air valve 47, a flasher light pocket 44, and an apron 46 for attaching the collapsible marker portion 40 to the weighted base 20. The inflatable bag 42 is made of any air-impervious, flexible material, such as polyethylene, vinyl, or other plastics. The air valve 47 is centrally mounted in the top of the inflatable bag 42, as shown in FIG. 3, and defines an air hole 48 which has a relatively large diameter to permit rapid inflation and deflation of the inflatable bag 42. The air valve 47 is provided with a complementary plug 50 for selectively sealing the air hole 48. As shown in FIG. 4, an air pump 54 is connected to the air hole 48 via a hose 55 and used to inflate the bag 42 comprising the collapsible portion 40 of road buoy 10.

The apron 46 is also made of a flexible material and is attached to the lower side wall of the inflatable bag 42. It extends around the inflatable bag 42 and depends downwardly therefrom for attaching the collapsible marker portion 40 to the weighted base 20. For this purpose, the apron 46 is provided with a plurality of female snap fasteners 52 which cooperate with the male snap fasteners 28 mounted on the weighted base 20 in detachably securing the collapsible marker portion 40 to the weighted base 20.

The flasher light pocket 44 can be used to hold a standard flasher light 45 for use as a warning and to increase the visibility of the road buoy at night. The flasher light pocket comprises a "box" which may be fabricated of the flexible material, and the back of the box is secured, as indicated at 43, to the outside of the inflatable bag 42, preferably on the upper portion of its side wall. The flasher light 45 is inserted and removed through an opening defined by a lip 51, which also retains the flasher light 45 in the flasher light pocket.

Thus, the road buoy 10 is lightweight and compact when collapsed, and is easily stored, handled and transported. It is also easily inflated to provide a large, highly visible road marker. If it is struck by a car, little or no damage to the car will result, and the road buoy itself can be readily repaired or replaced.

Another road buoy 11 according to the invention herein is shown in FIGS. 5 – 8. It generally comprises a weighted base 57, a collapsible marker portion 58, and a cover 36. The weighted base 57 is comprised of a bottom plate 30, and an integral upstanding cylindrical side wall 32. The base 57 is generally cup-shaped. The bottom plate 30 defines a curved centrally disposed well 34 which serves to contain ballast 35. Two diametrically disposed L shaped slots 39 are defined in the upper edge of cylindrical side wall 32 of the weighted base 57, and cooperate with cover 36, as will be described below.

Figure 6:
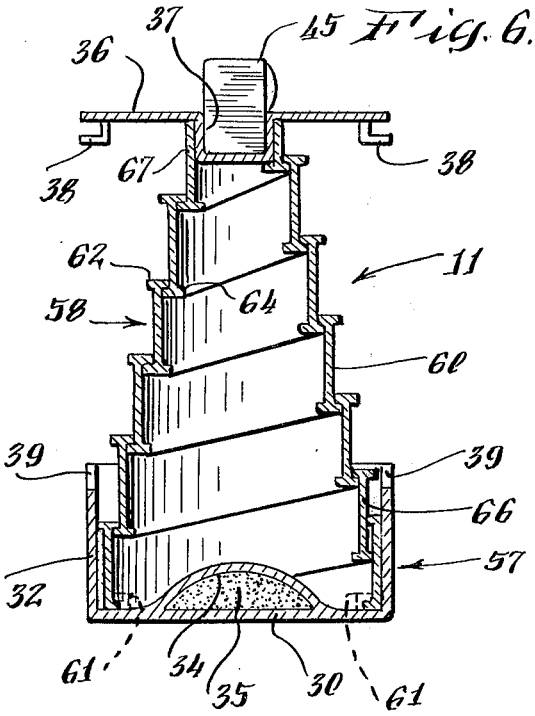
FIG. 6 is a sectional view of the road buoy of FIG. 5 taken along the lines 6—6 of FIG. 5.
Figure 7:
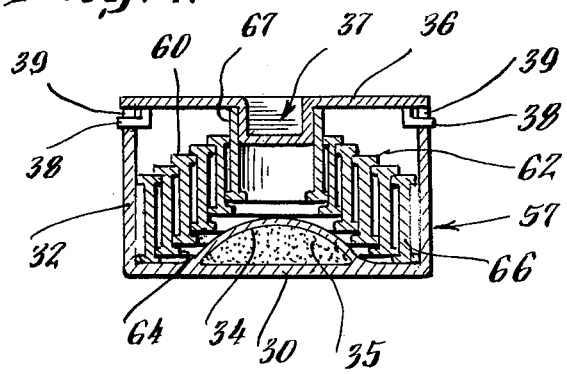
FIG. 7 is a sectional view of the road buoy of FIG. 5 shown in its collapsed condition.

The collapsible marker portion 58 consists of a single continuous spirally coiled strip 60 of flexible material, such as ABS plastic. As best seen in FIGS. 6 and 7, the strip 60 has an elongated I shaped cross section, and has a first flange 62 on its top edge and a second flange 64 on its bottom edge. The strip 60 is spirally coiled with the outermost coil 66 force fit or otherwise removably attached, such as by clips 61, to the inside of the cupshaped base 57. Since each coil is slightly smaller than the preceding one, the first flange 62 and the second flange 64 of successive coils interengage when the strip 60 is telescopically expanded to prevent the collapsible marker portion 58 from being overextended.

The upper end of the strip 60, comprising an innermost coil 67, is attached to the central underside of the cover 36. The coil is preferably cut on a bias for this purpose. The cover 36 preferably includes an indentation 37, for optionally receiving a flasher light 45, and the strip 60 may be wrapped about and secured to the underside of the identation 37.

The cover fits on top of the wall 32 of the weighted base 57 opposite the bottom plate 30 when the road buoy 11 is in the collapsed condition shown in FIG. 7. The underside of the cover 36 is provided with a pair of depending, outwardly extending L shaped locking tabs 38. As shown in FIG. 8, the pair of locking tabs 38 are positioned 180° apart and are operative to fit into the pair of L shaped slots 39 in the side of the wall 32 of the base 57. When the collapsible marker portion 58 of road buoy 11 is collapsed into its storage position, as shown in FIG. 7, the entire strip 60 fits inside the cupshaped base 57 and the locking tabs 38 are received in bayonet engagement in the slots 39. The cover 36 is thereby locked to the wall 32 of the base 57, and the road buoy 11 comprises a compact, lightweight unit for storage and transportation, but at the same time is ready for instant use by merely unlocking the cover 36 and expanding the coiled strip 60 and pulling the cover 36 upward.

Figure 9:
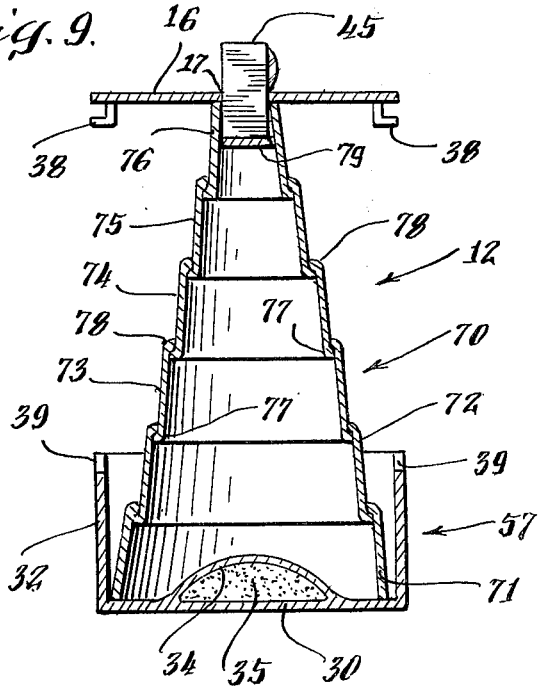
FIG. 9 is a sectional side view of another road buoy according to the invention herein in its extended condition.

The road buoy 12 shown in FIG. 9 is another embodiment of the invention herein which generally comprises a base 57, as described above, a collapsible marker portion 70, and a cover 16, similar to cover 36 described above. The collapsible marker portion 70 is comprised of a series of open-ended truncated cones 71 – 76. The truncated cones 71 – 76 are of progressively decreasing diameter and are concentrically arranged. The lowermost cone 71 is force fit into or attached by clips to the weighted base 57. The uppermost cone 76 is attached to the cover 16 about an opening 17 therein for receiving a flasher light 45, which rests on a cross member 79.

Truncated cone 73, for example, has an outwardly disposed first lip 77 on its bottom edge and an inwardly disposed second lip 78 on its top edge, and the other cones are similar. When the cones 71 – 76 are telescopically expanded, the upper and lower lips of adjacent cones interlock. Each cone friction fits tightly inside the adjacent larger one and holds the collapsible marker portion 70 in its expanded condition. The collapsible marker portion 70 collapses down into the cup-shaped base 57 for compact storage, handling and transportation in the same manner as previously described with respect to road buoy 11.

Figure 10:
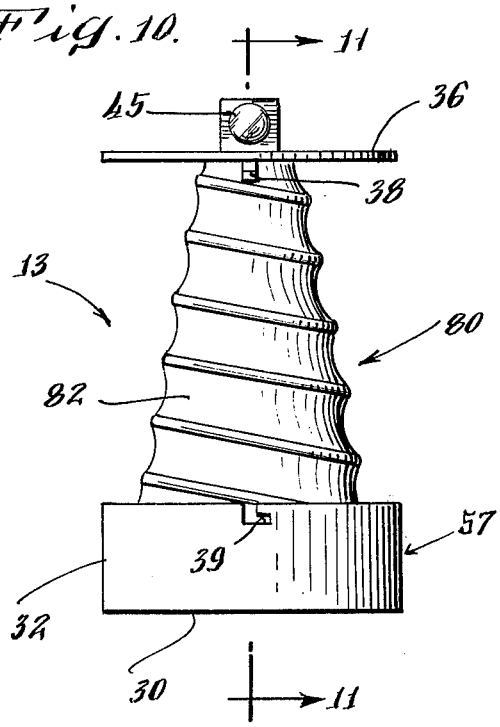
FIG. 10 is a front view of another road buoy according to the invention herein in its extended condition.
Figure 11:
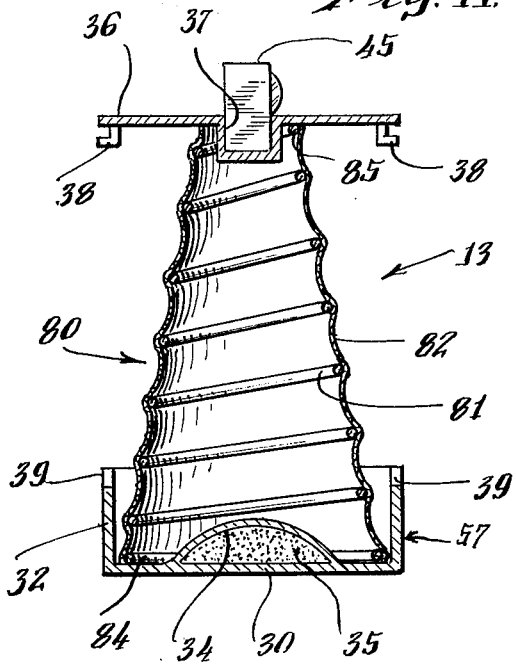
FIG. 11 is a sectional view of the road buoy of FIG. 10 taken along lines 11—11 of FIG. 10.
Figure 12:
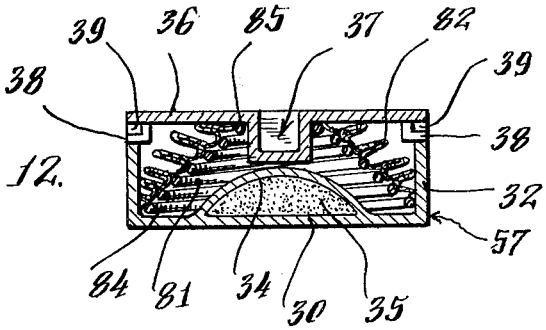
FIG. 12 is a sectional view of the road buoy of FIG. 10 shown in its collapsed condition.

A road buoy 13, which is another embodiment of this invention, is shown in FIGS. 10 – 12. It also generally comprises a base 57, cover 36, and collapsible marker portion 80. The weighted base 57 and cover 36 are as described above.

In this embodiment, the collapsible marker portion 80 is comprised of a spiral coil spring 81 having coils of progressively smaller diameter, and a flexible material 82, such as cloth or plastic, which is brightly colored and which covers the coil spring 81. As shown in FIG. 11, the largest diameter coil 84 is force fit into the bottom of the base 57 and the smallest coil 85 is attached to the underside of cover 36. Clips, not shown, may be used for a more secure attachment. When compressed, the coil spring 81 fits inside the cup-shaped weighted base 57 and the locking tabs 38 of the cover 36 cooperate with the L-shaped slots 39 of the wall 32 of the base 57, as previously described, to hold the cover 36 in place and prevent the coil spring 81 from expanding, as best illustrated in FIG. 12. When the cover 36 is unlocked, the coil spring 81 ezpands and the collapsible marker portion 80 is automatically extended to its full height expanded condition shown in FIG. 10.

Thus, the road buoy 13 provides a compact, easily-handled traffic marker. It can be easily repaired or replaced in sections, if necessary. It and the other embodiments of road buoys described above are much better adapted to serve as traffic markers than the prior art barrels.

With any of these embodiments, certain changes can be made without departing from the spirit and scope of the invention. Different means can be used to removably attach the collapsible section to the base, and it is also possible to lock the cover to the base by other methods or weight the base differently, for example.

Accordingly, the above description of the invention is to be construed as illustrative only, rather than limiting. This invention is limited only by the scope of the following claims.

I claim:

1. A road buoy comprising a weighted base and a marker portion detachably secured thereto, said marker portion expandable to an operational height and collapsible with respect to said weighted base to reduce said road buoy to a compact size for storage and transportation thereof, wherein said collapsible marker portion is comprised of a continuous strip of resilient, semi-rigid material, said strip having a first inwardly disposed lip on the top edge thereof and a second outwardly disposed lip on the bottom edge thereof, said strip spirally coiled so that said first lip and said second lip of successive coils interlock when said collapsible marker portion is telescopically expanded.

2. A road buoy as defined in claim 1 wherein said weighted base is comprised of a circular base plate defining a well centrally disposed thereon and an integral cylindrical side wall upstanding from the periphery of said base plate wherein said base is generally cup-shaped, and wherein said well contains ballast material for weighting said weighted base.

3. A road buoy as defined in claim 2 and further comprising a cover, said cover comprising a circular plate secured to the upper edge of said spirally coiled strip and being adapted to be removably secured to the top of the cylindrical side wall of said weighted base to enclose said collapsible marker portion, when collapsed, in said weighted base.

4. A road buoy as defined in claim 3 wherein said cover includes a depression defining an open pocket for receiving and holding a flasher light.

* * * * *